United States Patent [19]

Linstromberg

[11] 3,964,269

[45] June 22, 1976

[54] SENSING ARM WATER FILL SHUT OFF FOR ICE MAKER

[75] Inventor: William J. Linstromberg, Evansville, Ind.

[73] Assignee: Whirlpool Corporation, Benton Harbor, Mich.

[22] Filed: Nov. 21, 1974

[21] Appl. No.: 525,791

[52] U.S. Cl. ..... 62/137; 62/233
[51] Int. Cl.[2] ..... F25C 5/18
[58] Field of Search ..... 62/137, 233

[56] References Cited

UNITED STATES PATENTS

| | | | |
|---|---|---|---|
| 3,040,542 | 6/1962 | Linstromberg | 62/137 |
| 3,675,437 | 7/1972 | Linstromberg | 62/137 |

*Primary Examiner*—William E. Wayner
*Attorney, Agent, or Firm*—James S. Nettleton

[57] ABSTRACT

A control for shutting off an automatic ice maker in a refrigeration apparatus, such as a refrigerator-freezer. The ice maker apparatus is driven by an electric motor which is permitted to run continuously and thereby provide additional timing functions for other controls in the refrigeration apparatus. The ice maker mechanism is caused to be inoperative for purposes of providing ice bodies such as when the level of collected ice bodies in a storage bin reaches a preselected full level. The ice maker mechanism is made inoperative for providing ice by preventing delivery of water to the ice maker freezing mold. One end of a bin level sensing arm acting on and biased by a switch spring contact is utilized to prevent electrical conduction through the spring contact when a full level is detected by another end of the sensing arm.

9 Claims, 8 Drawing Figures

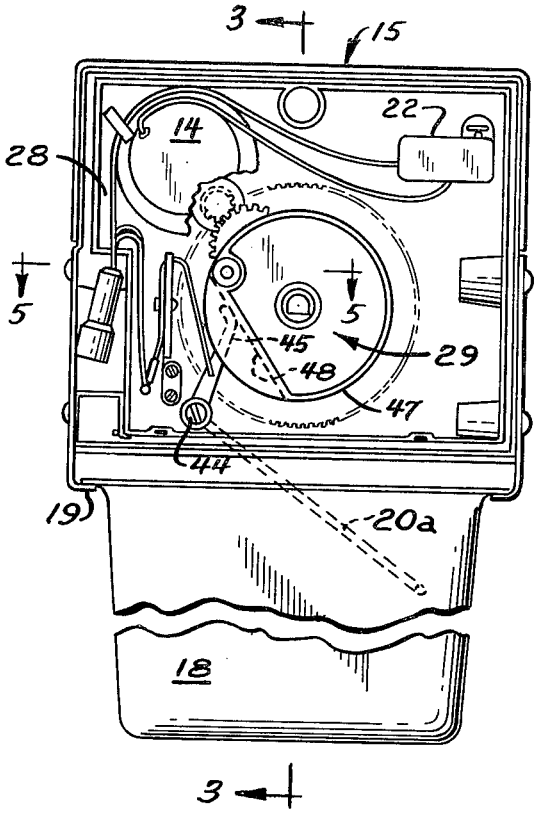
Fig. 4
Fig. 8
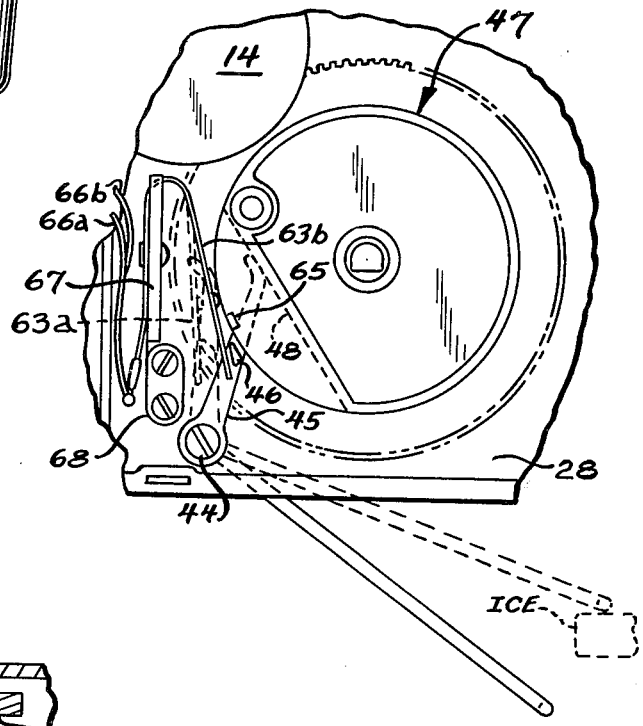
Fig. 5
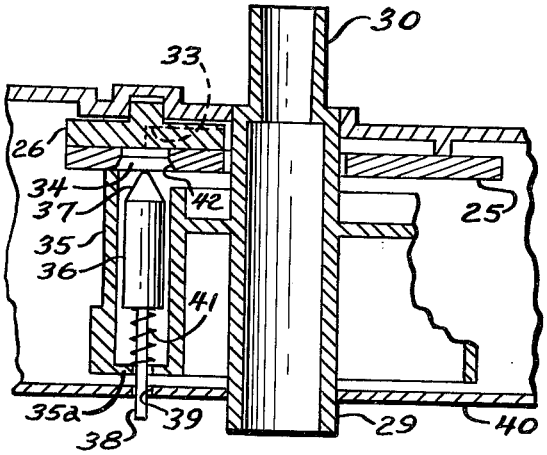

SENSING ARM WATER FILL SHUT OFF FOR ICE MAKER

BACKGROUND OF THE INVENTION

1. Field of the Invention

This invention relates to a refrigeration apparatus and in particular to apparatus for automatically making ice bodies in an apparatus such as a refrigerator-freezer.

2. Description of the Prior Art

In controlling conventional automatic ice body maker devices, bin level switches have been utilized to deactivate the device when the bin reaches a preselected full level. One such device is disclosed in U.S. Pat. No. 3,675,437 wherein a bin level switch is operated in response to the weight of ice bodies in the bin to disconnect power from the water fill solenoid valve when the bin reaches the full level. The same patent further describes a sensing arm mechanism for water fill solenoid shut off arranged to sweep through the collecting bin by means of a cooperating spring biased carrier and timing cam. Another ice maker mechanism is shown in U.S. Pat. No. 3,217,506 wherein a bin lever is coupled to a switch contact to deactivate the entire mechanism whenever a full bin level is detected. Both of the above described devices require special biasing springs for the bin levers and also require separate and complicated timing means for the water fill solenoid.

SUMMARY OF THE INVENTION

The present invention comprehends an improved control mechanism for controlling the water fill to the ice making mold. In the present invention the ice body maker mechanism is permitted to be driven continuously through its normal cycle except that under certain conditions delivery of water for forming ice bodies in the freezing mold is prevented. A switch means is provided for electrically completing a circuit for the water delivery means. The switch means includes a spring means which biases the switch contacts and a bin level sensing arm. The spring means comprises two conducting leaf springs, each carrying a switch contact. The springs bias the contacts against a contoured cam surface having an electrically conductive portion for periodically electrically completing a circuit to connect the water delivery means to a source of power. A sensing arm is provided having a first end in association with the collecting bin and a second end biased by one of the leaf springs. The second end has a projection in contact with one of the springs and is operable in response to the first end detecting a full level in the bin to prevent at least one of the contacts from contacting the cam surface.

Other features and advantages of the invention will be apparent from the following description taken in connection with and accompanying the drawings wherein:

FIG. 4 is a front elevation thereof with portions removed to facilitate illustration of the control mechanism;

FIG. 5 is a fragmentary transverse section taken substantially along the line 5—5 of FIG. 4;

FIG. 8 is a fragmentary enlarged front elevation of a portion of a mechanism of FIG. 4.

DESCRIPTION OF THE PREFERRED EMBODIMENT

Figure 3:
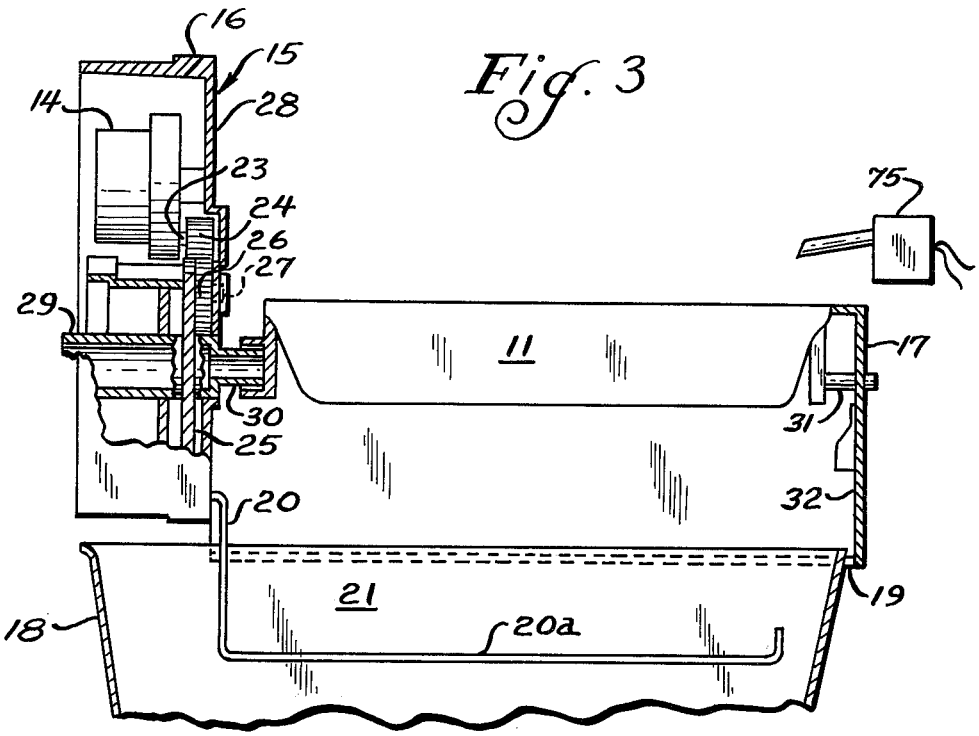
FIG. 3 is a fragmentary vertical section thereof taken substantially along the line 3—3 of FIG, 4.
Figure 1:
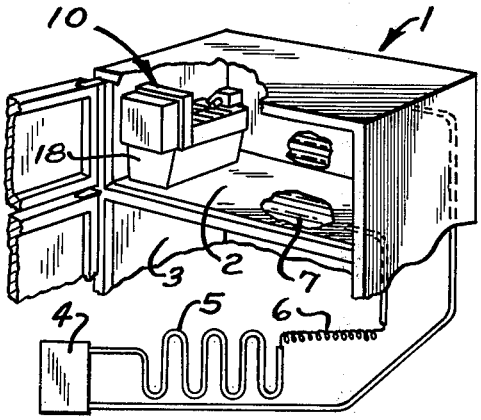
FIG. 1 is a fragmentary perspective view of a refrigeration apparatus incorporating the invention.
Figure 2:
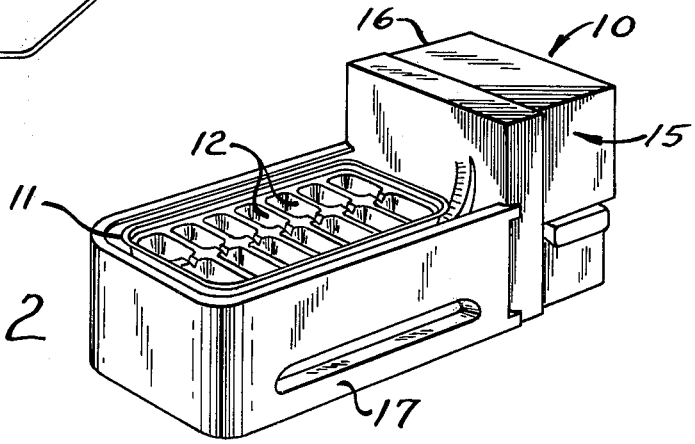
FIG. 2 is an isometric view of an ice body maker embodying the invention.

In the exemplary embodiment of the invention as disclosed in the drawing, a refrigeration apparatus generally designated 1 is shown to comprise a freezer section 2 and a fresh food storage section 3. The apparatus further includes a compressor 4, a condenser 5, a capillary 6 and evaporator 7. Located within freezer section 2 an ice maker generally designated 10 is shown to comprise a mold 11 defining a plurality of cavities 12 adapted to receive water to be frozen into a plurality of ice bodies. Mold 11 is mounted for rotation about a horizontal axis whereby the ice bodies may be formed with a mold cavity opened upwardly and may be discharged from the mold by turning the mold to an inverted position with the cavities opening downwardly subsequent to a suitable freeing of the ice bodies from the walls of the mold such as by twisting the mold. Rotation of the mold is effected by an electric drive motor 14 forming a part of a control mechanism generally designated 15 mounted in a suitable housing 16. The mold may be partially received within an enclosure wall 17 projecting forwardly from housing 16 as shown in FIG. 2. A receptacle 18 is slidably carried on suitable brackets 19 to be disposed subjacent the mold to receive the discharged ice bodies in the harvesting operation as shown in FIG. 3. Mechanism 15 includes a sensing arm 20 adapted to swing an end 20*a* through the upper portion of a space 21 within collecting bin 18 thereby to sense the level of ice bodies collected in the bin. When the sensing arms senses a full condition, the condition at which a level of ice bodies is at least at a preselected full level, it causes a discontinuation of the ice body forming process, thereby providing a suitable control of mechanism 15. The present invention comprehends an improved mechanism for effecting this discontinuation.

More specifically, as shown in FIG. 3, motor 14 is provided with an output shaft 23 turning a pinion gear 24. Pinion gear 24 drives a pair of gears, main drive gear 25 and spur gear 26. Spur gear 26 is made for rotation on a stub shaft 27 received in a front wall 28. Main drive gear 25 is rotatably mounted on a tubular shaft 29. Shaft 29 includes a forward projection 30 connected to one end of mold 11 whereby rotation of tubular shaft 29 effects the desired rotation of mold 11 into the cyclic ice maker operation discussed above. The opposite end of the mold 11 may be rotatably mounted by means of a stub shaft 31 pivoted in a front portion 32 of the enclosure wall 17.

As best seen in FIG. 5, spur gear 26 includes a rearwardly opening recess 33 and drive gear 25 includes an opening 34 which becomes aligned with recess 33 at periodic intervals as the result of the different rates of rotation of gears 25 and 26.

Carried on shaft 29 is a tubular housing 35 extending parallel to the axis of the shaft 29 and arranged to be aligned with opening 34 at one point in the relative rotation of the drive gear 25 on shaft 29. A pin 36 is slidably mounted in housing 35 to have a nose portion 37 enter into opening 34 when the opening is aligned. Pin 36 carries a rearward extension 38 received in an opening 39 in a rear wall 40 of mechanism 15. A coil spring 41 extending between pin 36 and rear wall 35*a* of housing 35 biases the pin forwardly against the drive gear.

Nose portion 37 of pin 36 is frustoconical and is urged outwardly from opening 34 by a coacting portion 42 of gear 25 whenever the movement of the pin into the opening is limited by the engagement of nose portion 37 with the face of spur gear 26. The resultant movement of rearward extension 38 of pin 36 is not sufficient to remove it from the opening 39 in rear wall 40. Thus, under these conditions, no motion of shaft 29 is effected by the rotation of gear 25 as pin 36 merely moves in and out of opening 34.

However, when the condition occurs wherein spur gear recess 33 becomes aligned with the opening 34, nose portion 37 of pin 36 may enter fully into opening 34 so that the extension 38 of pin 36 is biased outwardly from opening 39 thereby freeing the tubular housing 35 and the shaft 29 for rotation with gear 25.

Nose portion 37 of pin 36 moves outwardly from recess 33 to the circumferential edge of spur gear 26 permitting the pin to move in an annular path in locked association with gear 25 and opening 34 for one complete revolution of gear 25. On completion of the revolution, nose portion 37 of pin 36 reenters the recess in spur gear 26 and is cammed outwardly thereby to restore extension 38 through opening 39 in rear wall 40 once again locking shaft 29 against rotation with gear 25. A more detailed description of this functioning is presented in U.S. Patent No. 3,382,682 issued to E. H. Frohbieter on May 14, 1968 for "Method For Harvesting Ice Bodies And Apparatus For The Same".

Figure 6:
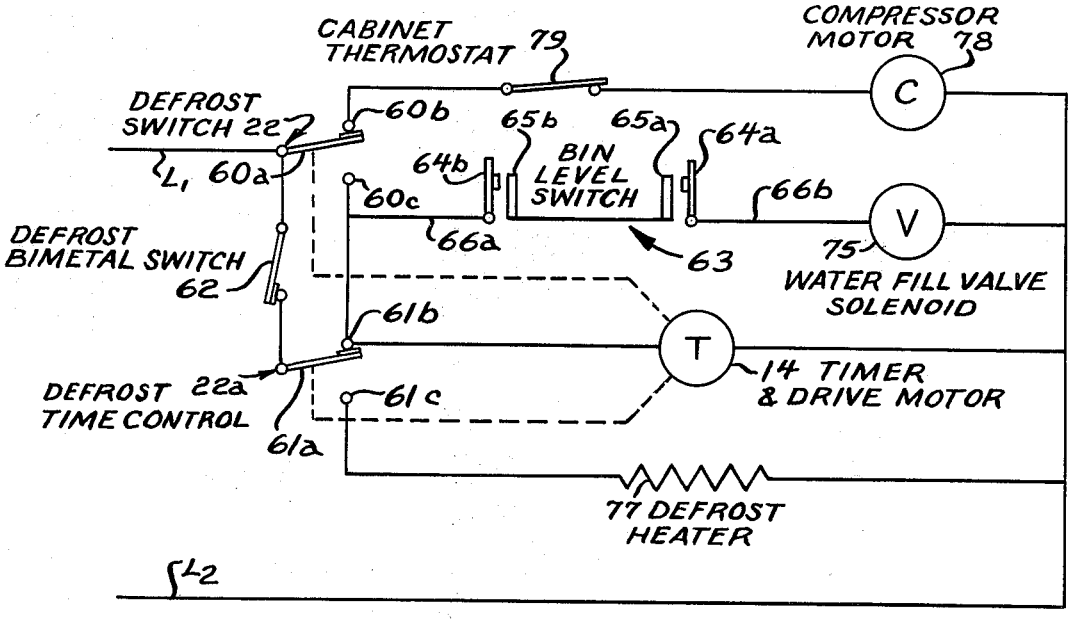
FIG. 6 is a schematic electrical wiring diagram illustrating the control for the ice body maker.

As shown in the wiring diagram of FIG. 6, the refrigeration apparatus includes a conventional compressor motor 78 for effecting suitable refrigeration to form the ice bodies in mold 11. The compressor motor is controlled by a conventional cabinet thermostat 79. Further, timer and ice maker drive motor 14 is caused to run continuously and thereby is available to control the periodic energization of a suitable defrost heater 77 for automatically defrosting the refrigeration apparatus.

The control 15 is operated by the motor 14 and normally functions to harvest successive batches of ice bodies from the mold 11 by repeated cycling of the ice body mechanism. However, when the ice bodies in bin 18 reach the preselected full level as sensed by arm, 20 the discontinuation of the ice body forming process is caused by preventing energization of a solenoid valve 75 to starve the ice maker of water.

In the present structure, as shown in FIG. 6, the control circuit is fed from suitable supply leads L1 and L2. The circuit includes a defrost control switch 22 having a pair of defrost switches, defrost switch 22 and defrost time control switch 22*a*. Switch 22 comprises a single pole double throw switch having a moving contact 60*a* connected to power supply lead L1, a fixed contact 60*b* connected to cabinet thermostat switch 79 and a fixed contact 60*c* connected to bin level switch 63 and timer motor 14. Defrost time control switch 22*a* comprises a single pole double throw switch having its moving contact 61*a* connected through a normally closed defrost bimetal switch 62 to power supply lead L1. A first fixed contact 61*b* is connected to fixed contact 60*c* of switch 22, and a second fixed contact 61*c* connected to the defrost heater 77. The other side of each of compressor motor 78, water valve solenoid 75, timer motor 14, and defrost heater 77 are connected to power supply lead L2. Defrost control switch 22 may be operated by a gear mechanism, not shown, like that disclosed in FIG. 4 of U.S. Pat. No. 3,714,794 issued to W. J. Linstromberg et al and assigned to the assignee of this application.

When the timer motor 14 times a preselected period of time a defrost operation is initiated by throwing of switch arms 60a and 61a of defrost control switches 22 and 22*a* from the position of FIG. 5 into contact with fixed contacts 60*c* and 61*c* respectively. Thus, operation of the compressor is prevented at this time and energization of the defrost heater 77 is effected through switch 22*a* and normally closed switch 62. In the event that the temperature sensed by switch 62 does not reach a preselected high temperature during a defrost period, motor 14 causes switch arms 60*a* and 61*a* to be thrown back to the position of FIG. 6 terminating the defrost heating cycle and re-establishing the circuit for further ice body formation and harvesting cycles. While the switch arm 60*a* is thrown to fixed contact 60*c* the timer motor remains energized therethrough and water fill solenoid valve 75 may be energized by the closing of switch 63. Thus, timer motor 14 may be utilized as a continuous timer motor to control switches 22 and 22*a* to effect the automatic defrosting cycle even though the circuit through switch 63 may be open to prevent the operation of water filled solenoid 75 and further forming of ice bodies.

Figure 7:
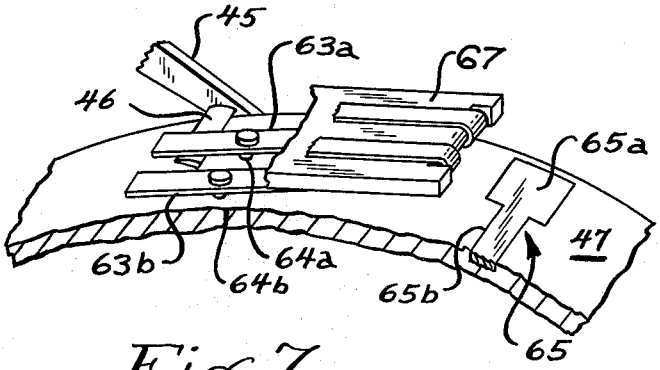
FIG. 7 is a fragmentary isometric view of a switch mechanism embodying the invention.

Referring now to FIGS. 4, 7 and 8 the operation and construction of the sensing arm 20 and the bin level switch 63 is explained. Switch 63 comprises two spring arms 63*a* and 63*b* having respectively switch contacts 64*a* and 64*b*. Spring arms 63*a* and 63*b* are carried on insulating support 67 mounted on wall 28 by suitable fasteners 68. Contact 64*a* is electrically connected through spring arm 63*a* and lead 66*a* to contact 60*c* of switch 22. Contact 64*b* is electrically connected through spring arm 63*b* and lead 66*b* to solenoid valve 75. The sensing arm 20 includes an upper portion 45 and is pivotally mounted on front wall 28 by a pin 44. Portion 45 of sensing arm 20 has a projection 46 which bears against spring arm 63*a* so as to bias portion 45 against the cam surface 47 carried by shaft 29. Cam surface 47 includes a recessed portion 48 which permits spring arm 63*a* to bias the lower end 20*a* of the sensing arm 20 downwardly into the bin while the remaining portion of cam surface 47 being circular is arranged to urge the sensing arm end 20*a* in a counterclockwise direction sufficiently to raise the sensing arm above the preselected full level during the remainder of the rotation of the shaft 29. Cam surface 47 further includes an electrically conducting section 65 such that once during each cycle of rotation of shaft 29 sensing arm 20 senses the level of ice bodies in the bin and in the event that the level is below the preselected level, sensing arm end 45 under the bias of spring arm 63*a* will follow cam surface 48 and thereby allow contact 64*a* to contact conductive portion 65 together with contact 64*b* to operate water solenoid valve 75 through the electrically conductive portion 65. However, in the event that the level of ice bodies collected in bin 18 is at least at the preselected full level, spring arm 63*a* is prevented by the action of sensing arm end 20*a* against the ice bodies from biasing the sensing arm portion 45 sufficiently in a clockwise direction to allow switch contact 64*a* to contact portion 65 and thereby to electrically conduct through portion 65 with contact 64*b* as shown in dotted lines in FIG. 8. Although the mold 11 and control mechanism 15 continue operation as though ice bodies are being formed in the mold, water solenoid valve 75 is not operated and no ice bodies are formed until such time as the bin level is again below the preselected full level. Thus, ice body formation is prevented by the absence of water addition to the mold and the ice maker "dry" cycles during this full bin condition.

The electrically conductive portion 65 of cam surface 47 combined with switch contacts 64*a* and 64*b* provides an accurate water filled timing which requires no adjustment as has been heretofore found in prior art devices. As shown in FIG. 7, the conductive portion 65 is T-shaped and positioned on cam surface 47 parallel to the axis of rotation of shaft 29. Portion 65*a* is wider than portion 65*b* such that contact 64*a* always contacts the conductive surface before and after switch contact 64*b*. Thus, the width of the conductive material 65*b* and the speed at which the surface 47 and accordingly shaft 29 is turned establish the time that the water solenoid valve 65 is energized. Accurate timing is therefore provided by the width of the conductive material at 65*b* which can be held to close tolerance in production.

Thus, the continuous operation of the timing motor 14 is effected to allow the refrigeration apparatus to operate through its normal defrost cycle and to drive the ice body making mechanism through its normal cycle. The bin level sensing arm is biased by the switch contact spring arm to control the admission of water to the mold as a function of the level of the ice bodies in the bin. Thus, a simply constructed, accurate, water-filled timing mechanism and ice body level bin sensing is provided.

The foregoing disclosure of the specific embodiment is illustrative of the broad inventive concepts comprehended by the invention.

Having described the invention, the embodiments of the invention in which an exclusive property or privilege is claimed are defined as follows:

1. Refrigeration apparatus comprising:
cooling means;
ice making means for automatically making ice bodies including a mold,
water delivery means for delivering water to the mold for cooling thereof by said cooling means to form ice bodies in said mold,
drive motor means;
harvesting means driven by said motor for cyclically harvesting the ice bodies from said mold including a collecting bin for removably storing the harvested ice bodies; and
shut off means preventing operation of said water delivery means whenever the level of ice bodies in said collecting bin is at a preselected full level thereof to permit continued operation of the ice making means by said drive motor while preventing forming of ice bodies thereby, said shut off means including,
a switch means having a plurality of switch contacts for electrically completing a circuit for said water delivery means, said switch means having a spring means for biasing said contacts for making said electrical connection,
and a bin level sensing arm, said arm having a first end in association with said bin for detecting said preselected full level and a second end biased by said spring means and operable in response to detection of said preselected full condition by said first end to prevent said contacts from completing said circuit.

2. The refrigeration apparatus of claim 1 wherein said harvesting means includes a rotatable cam having a contoured cam surface, and an electrically conducting portion, and said spring means comprises two electrically conducting leaf springs, each of said springs carrying one of said plurality of contacts, said springs biasing said contacts against said cam surface for periodic contact with said electrically conducting portion upon rotation of said cam.

3. The refrigeration apparatus of claim 2 wherein said second end of said sensing arm includes a projection contacting at least one of said leaf springs, said projection operable in response to said first end of said arm detecting said full level to prevent one of said contacts from contacting said cam surface.

4. The refrigeration apparatus of claim 2 wherein said second end of said sensing arm has a projection contacting one of said leaf springs, said second end is biased by said leaf spring against said contoured cam surface on said rotatable cam, said cam surface having a recessed portion adjacent said electrically conducting portion of said cam surface, said recessed cam portion positioning said projection to allow said contact on leaf spring to complete said circuit.

5. The refrigeration apparatus of claim 2 wherein said electrically conducting portion comprises a T-shaped conductive band transverse to the direction of rotation of said cam surface, and wherein one of said leaf spring contacts is positioned to pass over the stem portion of said T-shaped band and the other of said leaf spring contacts is positioned to pass over the top portion of said T-shaped band.

6. Refrigeration apparatus comprising:
cooling means;
ice making means for automatically making ice bodies including a mold,
water delivery means for delivering water to the mold for cooling thereof by said cooling means to form ice bodies in said mold,
drive motor means;
harvesting means including a rotatable cam surface driven by said motor for cyclically harvesting the ice bodies from said mold including a collecting bin for removably storing the harvested ice bodies;
switch means having a plurality of contacts for electrically completing a circuit for said water delivery means, said switch means including a spring means for biasing said contacts against said cam surface, said cam surface having an electrically conductive portion for periodically connecting said contacts,
and a bin level sensing arm biased by said spring means and operable in response to the level of ice bodies in said collecting bin reaching a predetermined full level to prevent at least one of said contacts from contacting said cam surface.

7. The refrigeration apparatus of claim 6 wherein said spring means comprises two electrically conducting leaf springs, each of said springs carrying one of said plurality of contacts and said sensing arm includes a first end in association with said bin and a second end, said second end having a projection contacting at least one of said leaf springs, said leaf spring biasing said projection and thereby said second end to cause said first end to detect said full level of ice bodies in said bin upon rotation of said cam.

8. The refrigeration apparatus of claim 7 wherein said one of said leaf springs biases said second end against said contoured cam surface, said cam surface includes a recessed portion and a conductive portion, said recessed portion being adjacent said conductive portion of said cam surface, and said recessed portion positions said projection to allow said contact on said leaf spring to complete said circuit upon rotation of said cam.

9. The refrigeration apparatus of claim 6 wherein said spring means comprises two leaf springs each carrying one of said contacts and said electrically conducting portion comprises a T-shaped band transverse to the direction of rotation of said cam surface, one of said leaf spring contacts positioned to pass over the top portion of said T-shape and the other of said leaf spring contacts positioned to pass over the stem portion of said T-shape.

* * * * *